United States Patent [19]

Dolan et al.

[11] 4,260,243

[45] Apr. 7, 1981

[54] CLEANING APPARATUS

[75] Inventors: Donald T. Dolan; Salvatore J. Calvi, both of Ridgefield, Conn.

[73] Assignee: Pitney Bowes Inc., Stamford, Conn.

[21] Appl. No.: 84,963

[22] Filed: Oct. 15, 1979

[51] Int. Cl.[3] ..... G03G 21/00

[52] U.S. Cl. ..... 355/15; 15/256.5; 118/652; 355/3 BE

[58] Field of Search ..... 355/15, 3 BE, 16; 118/652; 15/256.5, 1.5; 198/496, 497, 499

[56] References Cited

U.S. PATENT DOCUMENTS

| | | | |
|---|---|---|---|
| 2,878,926 | 3/1959 | Harty et al. | 198/497 |
| 3,523,319 | 8/1970 | Stoever | 15/256.5 X |
| 3,706,108 | 12/1972 | Taylor | 355/15 X |
| 3,859,691 | 1/1975 | Katayama et al. | 355/15 X |
| 3,918,808 | 11/1975 | Narita | 355/15 |
| 3,993,022 | 11/1976 | Zimmer | 118/652 |

*Primary Examiner*—Richard L. Moses

*Attorney, Agent, or Firm*—Melvin J. Scolnick; William D. Soltow, Jr.; Albert W. Scribner

[57] ABSTRACT

A cleaning apparatus for use in an electrostatographic reproducing machine to remove magnetic toner particles from a moving surface such as a photoreceptor or transfer belt is disclosed. The cleaning apparatus comprises a frame member which includes means for containing toner particles therein; scraping means positioned in contiguous relation to said moving surface whereby toner particles adhering to the surface are removed therefrom; and magnetic means positioned on the frame opposite to the location of the scraping means for attracting the magnetic toner particles away from the moving surface and into the container means.

8 Claims, 2 Drawing Figures

CLEANING APPARATUS

BACKGROUND OF THE DISCLOSURE

I. Field of the Invention

This invention relates to a cleaning apparatus as is commonly used in xerographic copying machines, and more particularly to a simple and inexpensive cleaning apparatus which removes magnetic toner particles from a moving surface within the machine by employing the combined effects of a mechanical scraping device and magnetic attraction.

II. Description of the Prior Art

In a typical xerographic process a photoconductor comprising a photoconductive composition coated on a rigid or flexible substrate is uniformly electrostatically charged in the dark, and then exposed by being illuminated in an image pattern in accordance with graphic material on an original document. The photoconductor becomes discharged in the areas exposed to the illumination, but retains its electrostatic charge in the dark areas, which areas correspond to the graphic material on the original document. The resulting electrostatic latent image is developed by depositing on the photoconductor a finely divided electrostatically attractable developing material (toner). The toner will normally be attracted to those areas on the photoconductor which retain a charge, thereby forming a toner image corresponding to the electrostatic latent image. This visible image of developing materials is then transferred to a support surface, such as plain paper or any other suitable substrate, to become the ultimate copy. Any residual developing material remaining on the photoconductor is removed therefrom by a cleaning device and the photoconductor is reused as described above for subsequent copies. The toner image that was transferred to the plain paper is then fixed thereto by either a heat or cold fusing process. If, for example, the developing material is heat fusible, application of sufficient heat to the paper causes the developing material to melt and be fused into the paper so as to be permanently affixed thereto.

It is during the transfer operation that it is desired to transfer all of the toner forming the image configuration to a suitable substrate, such as plain paper. However, it is fairly common during the transfer operation that toner particles remain on the surface from which the particles are transferred. If these toner particles were allowed to remain on, for example, the photoconductor surface, the particles would tend to accumulate and transfer to the next sheet of paper contacting the photoconductor, thus producing dirty copies. This process is commonly referred to in the printing art as "offset".

Various types of cleaning devices have been developed for copiers to avoid the above-identified problem and remove excess toner particles from a transfer surface. For example, the prior art discloses brush type cleaning devices which generally comprise one or more rotating brushes for removing the toner particles from a surface in combination with a flicker bar for cleaning the brush and a stream of air which carries the removed particles into a filtering system. Typical brush cleaning systems are illustrated in U.S. Pat. Nos. 3,278,932 and 3,483,679. The prior art also discloses various types of web cleaning devices which are typically fibrous webs that are moved relative to the surface to be cleaned and in contact therewith so as to remove the particles. See U.S. Pat. Nos. 3,186,838 and 3,615,397 for typical examples of this type of device. A third class of cleaning devices for copying machines are the blade type cleaning devices which generally include a flexible cleaning blade that is placed in contact with the surface to be cleaned so as to wipe the excess toner particles from the surface as the surface moves past the blade. Examples of this type of device are illustrated in U.S. Pat. Nos. 3,552,850, 3,660,863 and 3,871,762.

There are, however, various disadvantages in using each of the types of cleaning devices described above. For example, a cleaning apparatus such as the cleaning brush combined with an air flow and filter system require complicated and expensive apparatus which also tend to effect the reliability of the machine. Several of the known web cleaning devices are also complicated in structure, expensive and require constant maintenance. Furthermore, many of the web and blade cleaning devices cause abrasion of the sensitive surfaces being cleaned. Abrasion of the photoconductor's surface causes an immediate deterioration of copy quality. In addition, many of these systems often fail when a magnetic toner is used because of the strong bond of the magnetic toner particles to the surfaces which require cleaning.

SUMMARY OF THE INVENTION

It is therefore an object of the present invention to overcome many of the disadvantages typically encountered when employing the types of cleaning apparatus described in the prior art, and to provide a cleaning apparatus that will permit easy removal of magnetic toner particles.

It is a further object of this invention to provide a cleaning apparatus that is simple in design and inexpensive.

It is a further object of this invention to provide a cleaning apparatus that will not generally interfere with the copying machine's reliability and add to its maintenance requirements.

It is still a further object of this invention to provide a cleaning apparatus that will remove magnetic toner particles from a sensitive surface, such as a photoreceptor, without causing abrasion thereof.

The foregoing objects and others are accomplished in accordance with the present invention by providing a cleaning apparatus for use in an electrostatographic reproducing machine for removing magnetic toner particles from a moving surface found within the machine comprising a frame member including a container means; scraping means positioned in contiguous relation to the moving surface whereby toner particles adhering to the surface are removed therefrom; and magnetic means positioned on the frame opposite to the scraping means for attracting the toner particles away from the surface and into the container means.

BRIEF DESCRIPTION OF THE DRAWINGS

For a better understanding of the invention as well as other objects and further features thereof, reference is made to the following detailed disclosure of this invention taken in conjunction with the accompanying drawings wherein.

DESCRIPTION OF THE PREFERRED EMBODIMENTS

Figure 1:
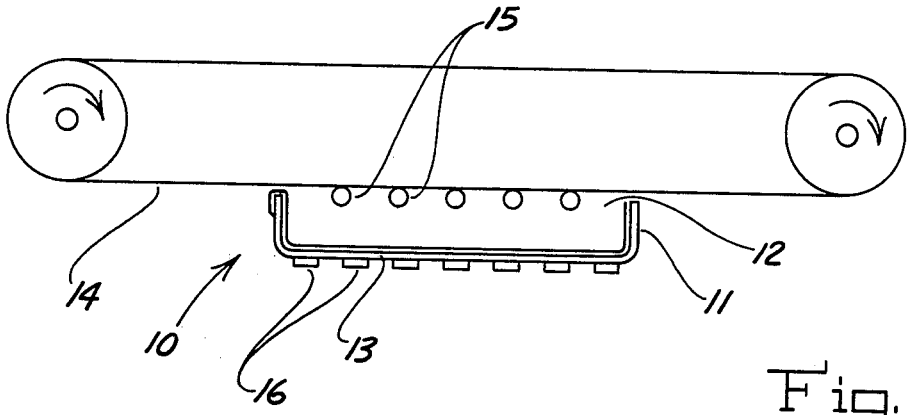
FIG. 1 is a schematic sectional view illustrating an embodiment of a cleaning apparatus in accordance with the invention positioned in a copier.

Referring now to the drawings and particularly to FIG. 1 thereof, there is shown an embodiment of a cleaning apparatus 10 for use in a xerographic reproducing machine in accordance with the present invention including a frame member 11 having an open top portion 12 and a closed bottom portion 13. The combination of frame 11 with bottom portion 13 forms a container which collects and stores all of the toner particles and other grit that is removed from moving surface 14 by apparatus 10.

The cleaning apparatus according to the present invention can be most efficiently used as shown in FIG. 1 to clean a belt type moving surface 14 which in a copier environment can be, for example, a photoreceptor belt or a transfer belt, i.e. a dielectric belt used for transferring a developed electrostatic image from a photoreceptor to a support surface.

Cleaning apparatus 10 is formed of a combination of frame member 11 that is removably mounted within a copier apparatus together with a scraping means that is positioned in contiguous relation to moving surface 14 to remove the magnetic toner particles therefrom. The scraping means is preferably in form of a plurality of wire elements 15 affixed to a frame of the copier itself such that removal of frame 11 from the copier leaves wire elements 15 in place within the copier. Since wire elements 15 are positioned in a touching relation to moving surface 14 for the purpose of removing any toner particles (including any other grit-like particles) from surface 14, and furthermore since it is desired that these surfaces not be scratched or otherwise abraded, it is preferred that elements 15 be made of a relatively soft, non-abrading material. Wire elements 15 can be formed of a number of different materials which can provide these features. For example, these elements can be made of any of numerous fibrous materials, such as cotton, in the form of a rope or brush. Metal brushes such as a stainless steel brush material can also be used. It is also preferred that a plurality of wire elements 15 be employed that traverse the flow path of the moving belt. For example, in FIG. 1 there is shown a plurality of substantially parallel wire elements that will extend between the end portions of frame 11 when frame 11 is positioned within the copier.

Secured to the outside bottom portion 13 of container 11 is a magnetic means in the form of a plurality of magnets 16 which provide the necessary magnetic attraction for attracting and helping to collect the magnetic toner particles, i.e. when they fall from surface 14, the particles will be attracted to and collect within container 11. Any type of magnetic material that can be secured to container 11 can be used. For example, a solid sheet of a magnetic material, strips of magnetic tape, or plastic magnets are just some examples of the various types magnetic means that can be secured to container 11.

Figure 2:
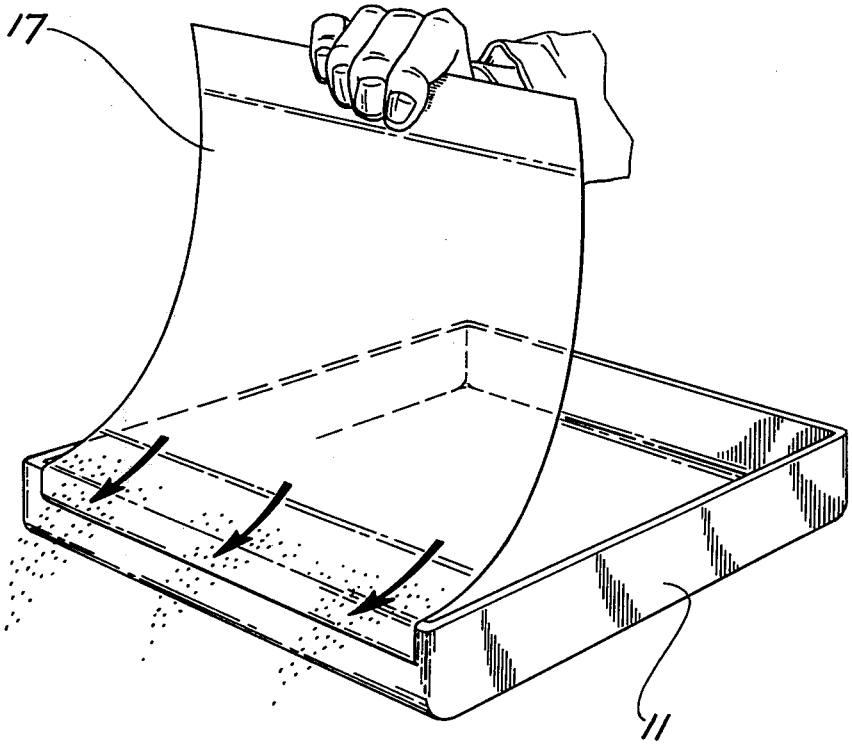
FIG. 2 is a perspective view of an embodiment of a portion of the cleaning apparatus in accordance with the present invention.

During the operation of a copier which employs the cleaning apparatus in accordance with the present invention, magnetic toner particles are scraped off of belt 14 by wire elements 15, and are thereafter magnetically attracted into container 11 by magnetic material 16. To allow for easy removal of the toner particles from container, there is provided as shown in FIG. 2 a sheet of material 17 that is preferably secured to one end portion of the container, which material lines the inside bottom portion of the container when apparatus 10 is in place in a copier. When it is desired to clean container 11, the container is removed from the copier and sheet 17 is lifted away from the container. The magnetic attraction between magnets 16 and magnetic toner particles 18 is thereby eliminated, and the particles can easily be reused or discarded. For this purpose, sheet 17 is preferably formed of any flexible material that would not be effected by the toner particles. For example, sheet 17 can be of mylar, silicon rubber, Teflon, or a Teflon coated material such as aluminum foil coated with Teflon.

While this invention has been described in conjunction with a specific embodiment thereof, it is evident that many alternatives, modifications and variations will be apparent to those skilled in the art. Accordingly, the present invention is intended to embrace all such alternatives, modifications and variations, and fall within the spirit and scope of the appended claims.

We claim:

1. A cleaning apparatus for use in an electrostatographic reproducing machine to remove magnetic toner particles from a moving surface of said machine comprising in combination:

a frame member including a container means;

scraping means positioned in contiguous relation to said moving surface to remove toner particles adhering to said surface; and magnetic means positioned on said frame opposite to said scraping means for attracting said toner particles away from said surface and into said container means said container means including means for breaking the magnetic attraction between the toner particles and said magnetic means whereby the toner particles can be removed from said container means.

2. A cleaning apparatus according to claim 1 wherein said scraping means is a plurality of wire elements.

3. A cleaning apparatus according to claim 2 wherein said wire elements are formed of a fibrous material.

4. A cleaning apparatus according to claim 2 wherein said scraping means is secured to said reproducing machine.

5. A cleaning apparatus according to claim 1 wherein said means for breaking the magnetic attraction is a flexible sheet of material covering the bottom portion of said container means.

6. A cleaning apparatus according to claim 5 wherein said flexible sheet of material is mylar.

7. A cleaning apparatus according to claim 1 wherein said moving surface is a transfer belt.

8. A cleaning apparatus according to claim 1 wherein said moving surface is a photoreceptor belt.

* * * * *